US007716935B2

(12) United States Patent
Kim et al.

(10) Patent No.: US 7,716,935 B2
(45) Date of Patent: May 18, 2010

(54) REFRIGERATOR FOR MANAGING FOOD BY USING RFID

(75) Inventors: Yong Tae Kim, Gimhae-si (KR); Eun Jeong Kim, Changwon-si (KR); Jong Min Shin, Busan (KR); Sun Cheol Bae, Masan-si (KR); Ku Young Son, Busan (KR); Yong Chol Kwon, Changwon-si (KR); Jae Seng Sim, Masan-si (KR); Su Won Lee, Changwon-si (KR); Deok Hyun Youn, Gimhae-si (KR); Byung Koo Kong, Changwon-si (KR); Eun Young Park, Ulsan (KR)

(73) Assignee: LG Electronics Inc., Seoul (KR)

( * ) Notice: Subject to any disclaimer, the term of this patent is extended or adjusted under 35 U.S.C. 154(b) by 975 days.

(21) Appl. No.: 11/440,440

(22) Filed: May 25, 2006

(65) Prior Publication Data

US 2007/0016852 A1 Jan. 18, 2007

(30) Foreign Application Priority Data

May 27, 2005 (KR) ..... 10-2005-0045184

(51) Int. Cl.
*F25B 49/00* (2006.01)
*F25D 11/02* (2006.01)
*G05D 23/00* (2006.01)

(52) U.S. Cl. ..... 62/126; 62/441; 236/51

(58) Field of Classification Search ..... 62/126, 62/129, 187, 441; 236/51, 94
See application file for complete search history.

(56) References Cited

U.S. PATENT DOCUMENTS 5,487,276 A * 1/1996 Namisniak et al. ..... 62/125
6,453,687 B2 * 9/2002 Sharood et al. ..... 62/127
6,519,963 B2 * 2/2003 Maeda ..... 62/259.2
6,741,236 B2 * 5/2004 Yun ..... 345/173
7,009,519 B2 * 3/2006 Leonard et al. ..... 340/572.8
7,406,439 B2 * 7/2008 Bodin et al. ..... 705/22
2002/0178066 A1 * 11/2002 Roh et al. ..... 705/22
2004/0031274 A1 * 2/2004 Cho et al. ..... 62/126
2004/0100380 A1 * 5/2004 Lindsay et al. ..... 340/540
2004/0107726 A1 * 6/2004 Kim et al. ..... 62/441
2004/0216476 A1 11/2004 Shin ..... 62/186

(Continued)

FOREIGN PATENT DOCUMENTS

DE 100 60 156 A 1 6/2002

(Continued)

OTHER PUBLICATIONS

European Search Report dated Sep. 29, 2006.

*Primary Examiner*—Marc E Norman
(74) *Attorney, Agent, or Firm*—KED & Associates, LLP

(57) ABSTRACT

Refrigerator for managing food by using RFID including a plurality of storage portions divided in the refrigerator for storing food, RFID devices each having storage information of each kind of food stored in the storage portions, and controller for reading the storage information and setting up the storage portion which maintains a storage condition suitable to the storage information read thus, thereby permitting easy storage of food in a storage portion having the storage condition by using the RFID device.

13 Claims, 6 Drawing Sheets

U.S. PATENT DOCUMENTS

| | | | | |
|---|---|---|---|---|
| 2005/0082956 | A1* | 4/2005 | Leistner et al. | 312/408 |
| 2005/0091996 | A1 | 5/2005 | Ishikawa et al. | 62/126 |
| 2005/0110373 | A1* | 5/2005 | Assmann | 312/249.8 |
| 2005/0132725 | A1* | 6/2005 | Menten et al. | 62/126 |
| 2005/0258961 | A1* | 11/2005 | Kimball et al. | 340/572.1 |
| 2007/0163275 | A1* | 7/2007 | Ha et al. | 62/135 |
| 2008/0047282 | A1* | 2/2008 | Bodin et al. | 62/129 |
| 2008/0184719 | A1* | 8/2008 | Lowenstein | 62/127 |
| 2008/0250797 | A1* | 10/2008 | Rozendaal et al. | 62/127 |

FOREIGN PATENT DOCUMENTS

| | | | |
|---|---|---|---|
| EP | 1 172 752 | A2 | 1/2002 |
| EP | 1 479 988 | A2 | 11/2004 |
| JP | 11-211319 | | 8/1999 |
| JP | 2000-310476 | | 11/2000 |
| JP | 2001-317859 | | 11/2001 |
| JP | 2002-81848 | | 3/2002 |
| JP | 2004-198043 | | 7/2004 |
| JP | 2005-96963 | | 4/2005 |
| WO | WO 02/35432 | A1 | 5/2002 |
| WO | WO 2006/062491 | A2 | 6/2006 |

* cited by examiner

FIG. 5

| items | storage starting date | a number of stored days | effective number of days of storage |
|---|---|---|---|
| 1 | '05. 01. 20 10:00 AM | stored for 7 days | 5 days (two days passed) |
| 2 | '05. 01. 25 03:10 AM | stored for 11 days | 10 days (one day passed) |
| 3 | '05. 02. 01 11:40 AM | stored for 4 days | 30 days |

* the most suitable gas composition in a case of apple ($CO_2$ 796)

REFRIGERATOR FOR MANAGING FOOD BY USING RFID

CROSS-REFERENCE TO RELATED APPLICATIONS

This application claims the benefit of Korean Application No. P2005-0045184, filed on May 27, 2005, which is hereby incorporated by reference as if fully set forth herein.

BACKGROUND OF THE INVENTION

1. Field of the Invention

The present invention relates to refrigerators for cold storage of food, and more particularly, to a refrigerator for managing food by using RFID, in which food can be stored and managed in a storage space which has an optimum storage condition in the refrigerator by using RFID devices.

2. Discussion of the Related Art

Depending on refrigerators, there are refrigerators that have a separate fresh storage chamber for the user to use selectively in maintaining freshness of the food stored therein. There are many kinds of food stored in the refrigerator. Because the user can not remember all kinds of the food in the refrigerator, the user is required to open/close a door of the refrigerator every time for determining the food stored therein. The verification of the food stored in the refrigerator by such a method causes waste of power following opening/closing of the refrigerator door, and decomposition of food of which a storage time period is passed, causing waste of food.

In order to solve such a problem, the inventor discloses an invention titled "a device for controlling display of food stored in a refrigerator in Korea Patent Registration No. 0377741, for determining kinds of food stored in the refrigerator from an outside of the refrigerator.

Referring to FIG. 1, a related art refrigerator is provided with an oscillation circuit 10 for generating a fixed frequency, a frequency demultiplying circuit 11 for demultiplying the frequency from the oscillation circuit 10 into a signal of a particular frequency, to generate time, time counting means 12 for receiving the signal from the demultiplying circuit and counting time, day counting means 13 for changing a day if a preset time comes with reference to the time counted at the time counting means 12, storage means 14 for storing various kinds of information on food stored in the refrigerator, a selection key unit 15 for a user to apply various kinds of information on kinds, amounts, time periods to be stored, and so on of the food to be stored thereto, a food storage number of days/time display unit 16 for a CPU 19 to renew and display a number of days and time of storage of food at fixed intervals, an expiration date passed food display unit 17 for displaying food having the expiration date passed, a stored food sequential display unit 18 for renewing and displaying information on food stored in the storage means 14 at fixed intervals, and a CPU 19 for displaying date/time of food stored, food having the expiration date passed, and food in storage presently in a sequence based on information on food stored in the storage means 14.

By using the foregoing system, the related art refrigerator stores information on stored food the user inputted personally through the selection key unit 15 in the storage means 14, and displays information on time/date of storage of food, on food of which deadline is passed, and on food in storage presently.

There has been inconvenience of manual input of names of a plurality of kinds of food in order to obtain information on food stored in the related art refrigerator. Since the selection key unit 15 is required to have an input capability similar to a keyboard for the input, the selection key unit 15 becomes complicate to increase a production cost of the refrigerator. Moreover, the input takes a substantial time period of the user.

Furthermore, because the related art refrigerator simply stores the various kinds of food in the refrigerator, and manages the food according to information displayed on the display unit 16, 17, and 18, there is a problem in that freshness, taste, and nutrition of the various kinds of food is degraded as the stored time period passes by.

SUMMARY OF THE INVENTION

Accordingly, the present invention is directed to a refrigerator for managing food by using RFID that substantially obviates one or more problems due to limitations and disadvantages of the related art.

An object of the present invention is to provide a refrigerator for managing food by using RFID, in which the most suitable positions of storage for various kinds of food in the refrigerator are selected automatically, and storage information is stored and managed automatically for convenient management of the stored food.

Another object of the present invention is to provide a refrigerator for managing food by using RFID, which can manage a particular position in the refrigerator to meet the most suitable storage condition of the food even if the food is stored in the particular position of the refrigerator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator for managing food by using RFID includes a plurality of storage portions divided in the refrigerator for storing food, RFID devices each having storage information of each kind of food stored in the storage portions, and controller for reading the storage information and setting up the storage portion which maintains a storage condition suitable to the storage information read thus.

The controller reads the storage information from the RFID device, and stores food managing information for the storage information.

The refrigerator further includes sensors for measuring storage conditions of the storage portions.

The refrigerator further includes display means for the user to notice the storage information and food managing information for the storage information, and the storage portion set up thus.

The storage portions include movable shelves such that a position at the time of placing of the food in the storage of the food and a stored position of the food after placing of the food are different.

In another aspect of the present invention, a refrigerator for managing food by using RFID includes a plurality of storage portions divided in the refrigerator for storing food, sensors on the storage portions for measuring storage conditions of the storage portions respectively, a plurality of RFID devices each having storage information of each kind of food to be stored in the storage portions, controller for reading the storage information from the RFID devices, storing food managing information for the storage information, and setting up the storage portion which maintains a storage condition suitable to the storage information read from the RFID device thus from the storage conditions of the storage portions measured by the sensors, and display means for the user to notice the storage information and the food managing information for the storage information from the controller, and the storage portion set up thus.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings;

FIG. 5 illustrates a preferred embodiment of food managing information applied to the present invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
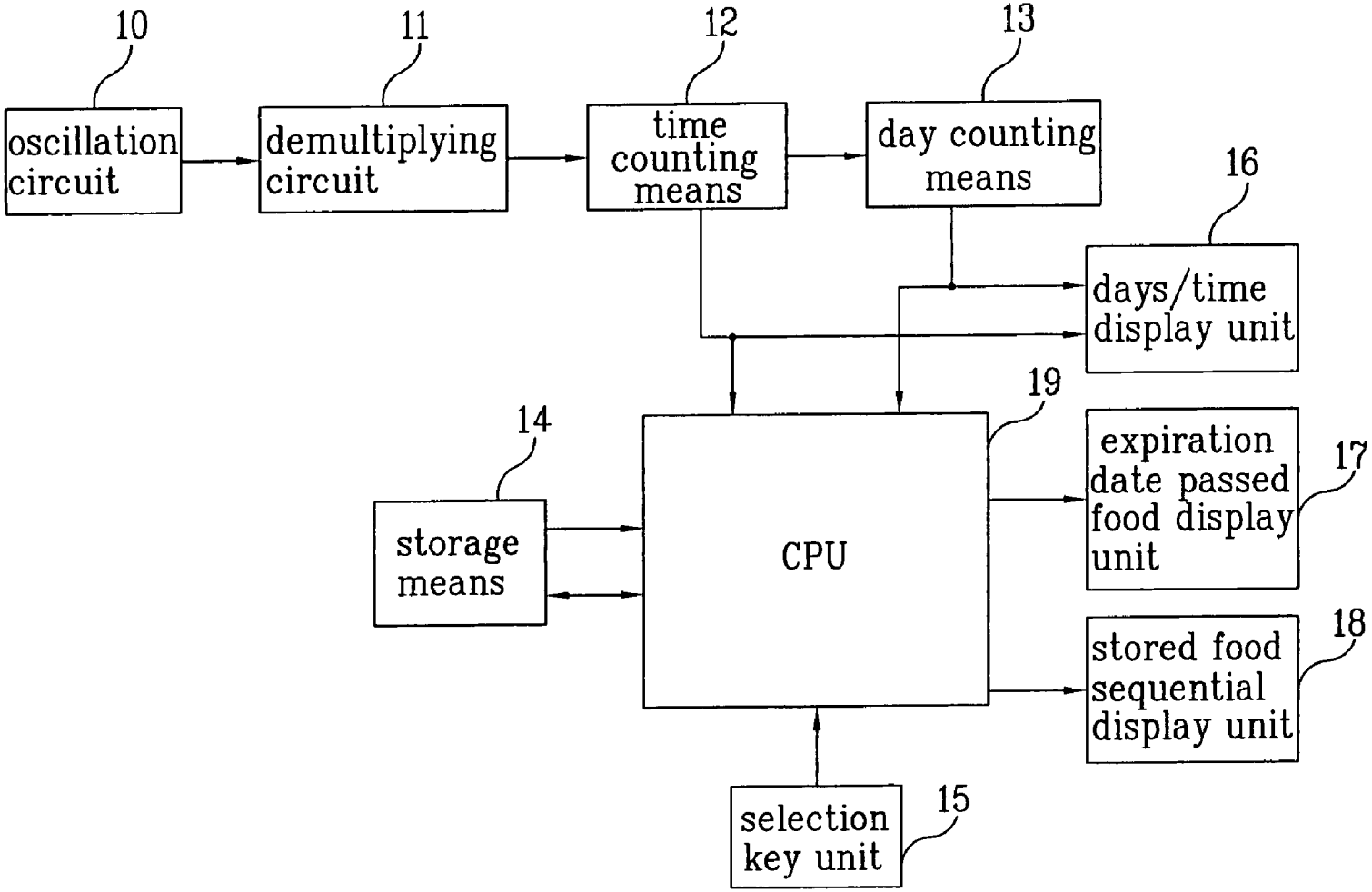
FIG. 1 illustrates a block diagram of a system of a related art refrigerator.
Figure 2:
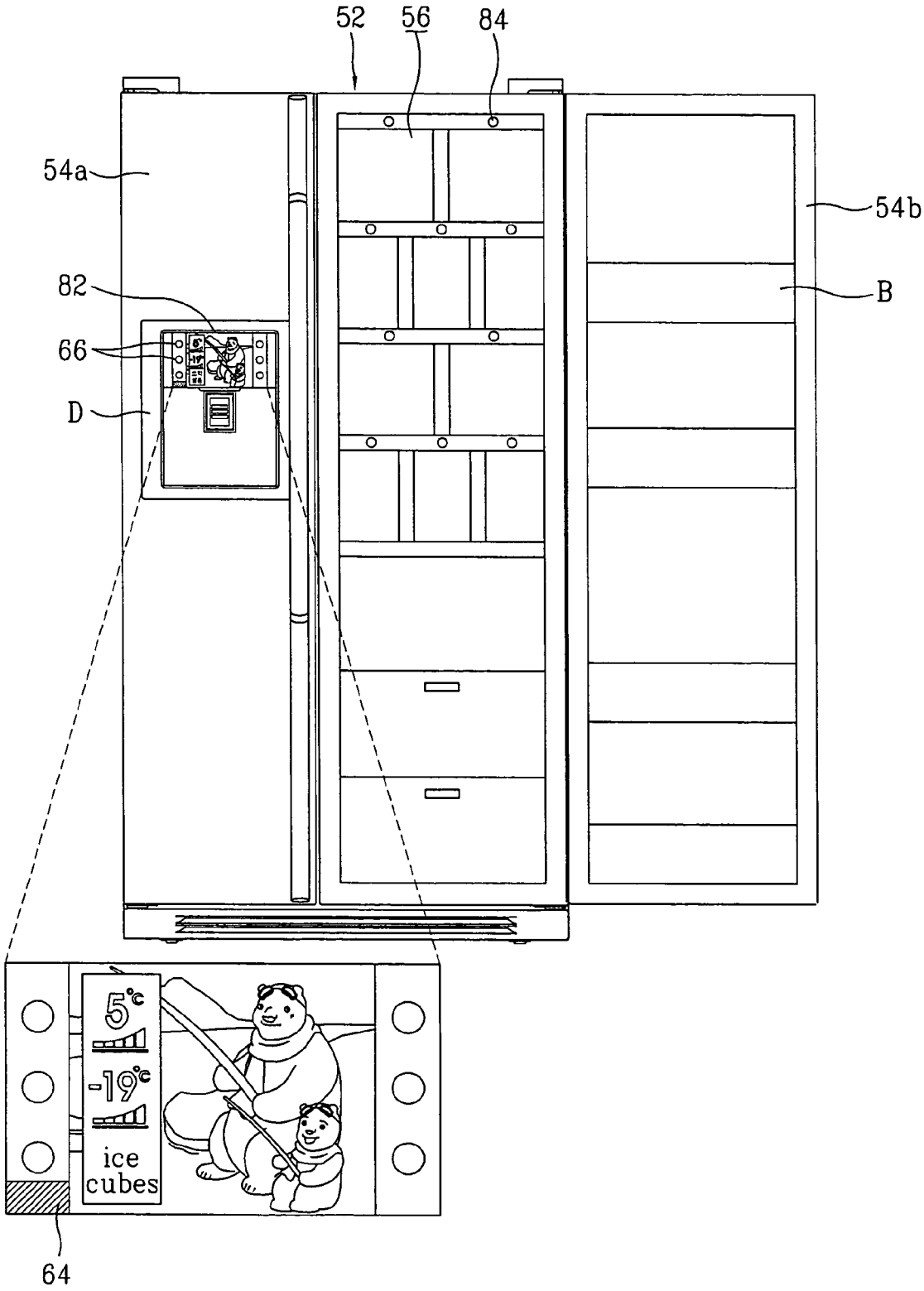
FIG. 2 illustrates a front view of a refrigerator for managing food by using RFID in accordance with a preferred embodiment of the present invention, with a partial enlarged view.
Figure 3:
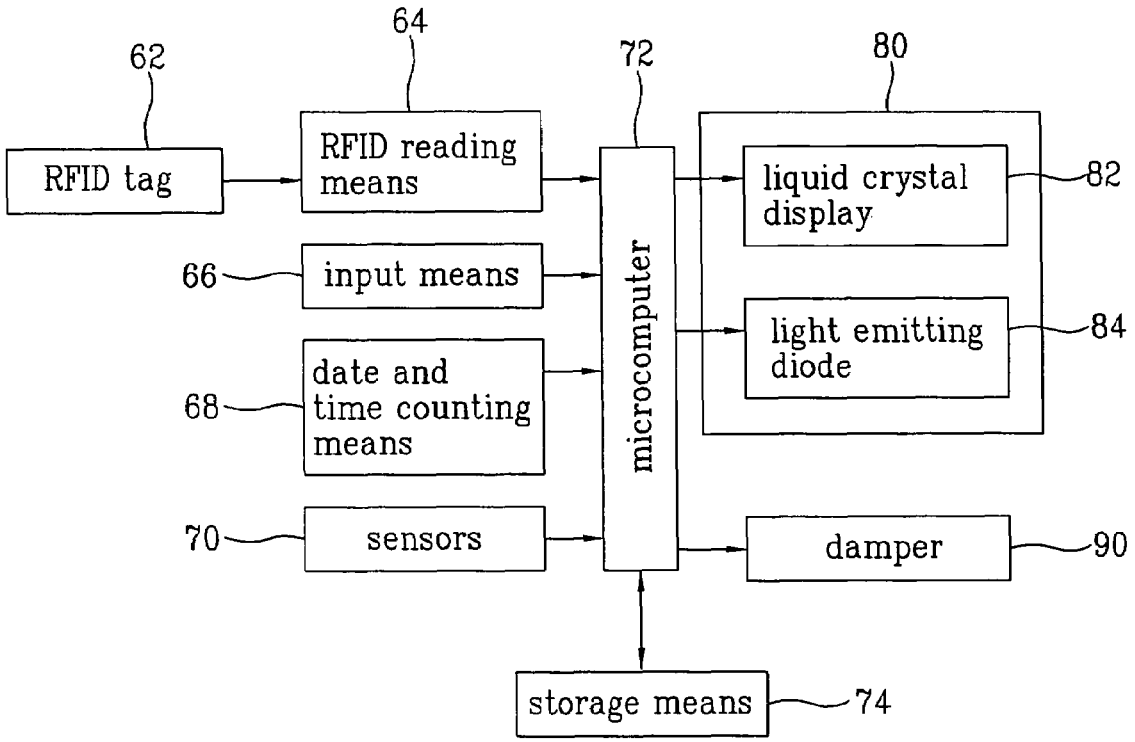
FIG. 3 illustrates a block diagram of a system of a refrigerator for managing food by using RFID in accordance with a preferred embodiment of the present invention.
Figure 4:
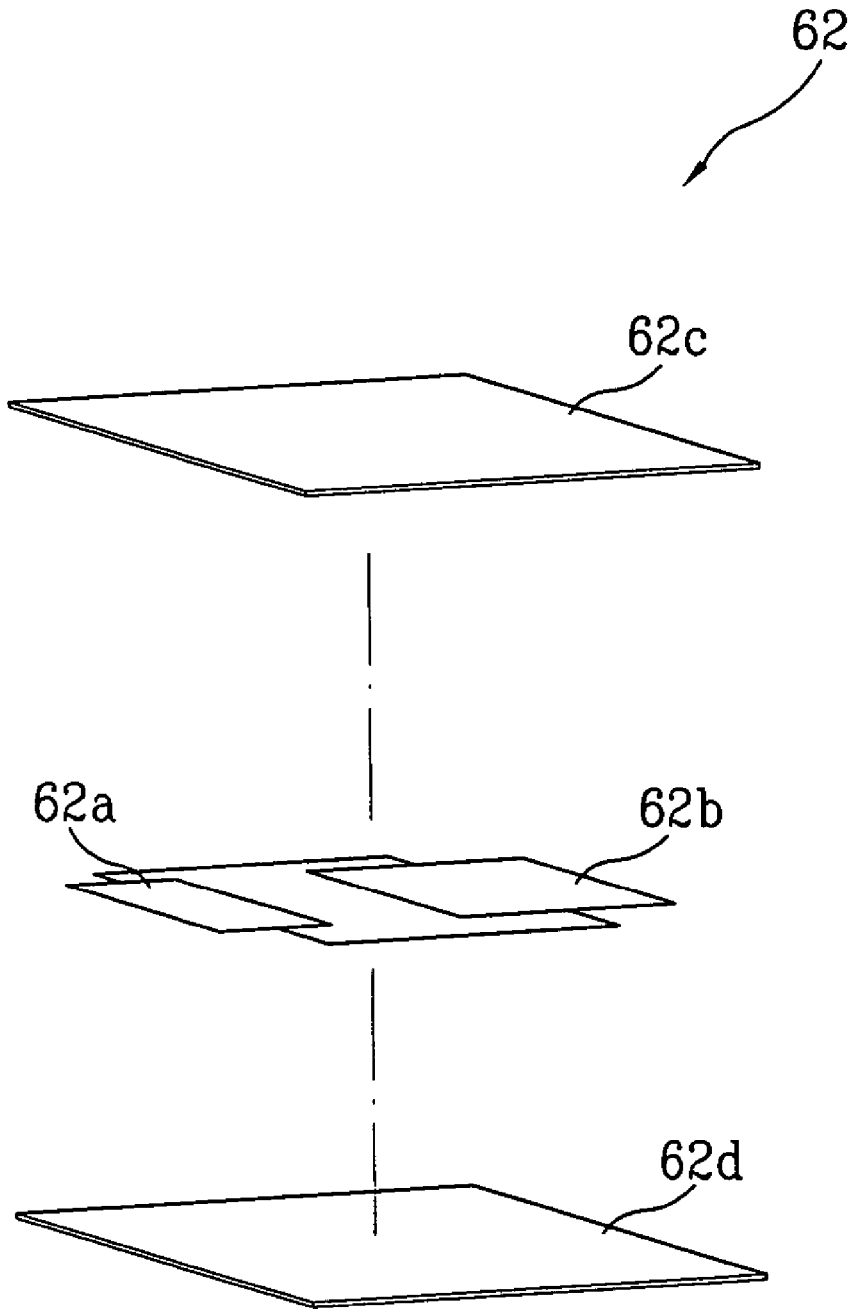
FIG. 4 illustrates an exploded perspective view of a RFID tag applied to the present invention.

FIG. 2 illustrates a front view of a refrigerator for managing food by using RFID in accordance with a preferred embodiment of the present invention, with a partial enlarged view, FIG. 3 illustrates a block diagram of a system of a refrigerator for managing food by using RFID in accordance with a preferred embodiment of the present invention, and FIG. 4 illustrates an exploded perspective view of a RFID tag applied to the present invention.

Referring to FIGS. 2 and 3, the refrigerator includes a freezing chamber door 54*a* and a refrigerating chamber door 54*b* mounted on a front of a refrigerator body 52 having a freezing chamber and a refrigerating chamber formed on opposite sides thereof, a plurality of storage portions 56 in the freezing chamber and refrigerating chamber for storage of food therein, each with various kinds of sensors 70 for measuring various storage conditions, controller (not shown) on the freezing chamber door 54*a* for reading and storing food managing information from information a RFID tag 62 stores in correspondence to the food stored in respective storage portions, and determining an optimum storage portion having a storage condition according to the food managing information, and display means (not shown) on the freezing chamber door 54*a* for displaying various kinds of information and the like obtained from the controller.

The refrigerator body 52 has a refrigerating cycle (not shown) with a compressor (not shown), a condenser (not shown), a capillary tube (not shown), an evaporator (not shown) built therein, a cold air circulating flow line (not shown) and a fan (not shown) for circulating the cold air built therein, holes (not shown) in an inside wall for introduction of the air passed around the evaporator to the storage portions 56, and dampers 90 on the cold air circulating holes or on partition walls (not shown) between the freezing chamber and the refrigerating chamber.

Operation of the compressor, dampers 90, and the cold air circulating fan is controlled by the controller according to load, to control a flow rate of the cold air, to control a temperature and humidity of the refrigerator.

While the refrigerating chamber door 54*b* have door baskets 'B' on insides for storage of food or the like, the freezing chamber door 54*a* has a dispenser unit 'D' on an outside for making ice and dispensing the ice easily, and the refrigerating chamber door 54*b* has a home bar (not shown) on an outside for easy dispensing of water, drink, and so on.

On the outside of the freezing door 54*a*, the controller is mounted for user's easy handling, as well as the display means is mounted for easy notice of an operation state of the refrigerator.

The storage portions 56, formed to sort and store various kinds of food in the freezing chamber and the refrigerating chamber, are divided in general into one sector for storing food and the other sector food stored therein can be managed, separately. The storage portions 56 will be described limited only to the other sector food stored therein can be managed, separately.

The storage portions 56 are constructed of various shelves and partitions, each of which may have a separate automatic opening/closing device on a front thereof for automatic/manual opening/closing.

Therefore, if the controller sets up the most suitable one of the storage portions 56, the automatic opening/closing device of the storage portion 56 is opened by the controller, for the user to place the food therein, directly.

Moreover, each of the storage portions 56 may have a shelf (not shown) mounted to be movable in up/down directions or front/rear directions, arranged at a position for the user to place the food the most easily in a state the freezing chamber door 54*a* or the refrigerating chamber door 54*b* is opened or closed, and designed to move to a position of the storage portion 56 in a state the user closes the freezing chamber door 54*a* or the refrigerating chamber door 54*b*.

Of course, it may be designed such that the movable shelf moves to the position of the storage portion 56 only when the controller sets up the storage portion 56, otherwise moves to other position the user desires or stops at the site.

Though the sensors 70 can be mounted to all of the storage portions 56 for detailed measurement of the storage conditions, the sensors 70 are mounted only some of the storage portions 56, taking ranges of sensing of the sensors 70 into account.

The storage conditions of the storage portions 56 that the sensors 70 can sense are temperatures, humidity, a cold air circulating rate, composition of air, vibration, a light quantity, and so on, for measuring which, various sensors, such as temperature sensors, humidity sensors, flow rate sensors, and so on are included.

Next, the controller includes RFID reading means 64 for obtaining storage information from information stored in the RFID tag 62, input means 66 for receiving an order from the user, date and time counting means 68 for defining year, month, and date and/or time, a microcomputer 72 for controlling above elements to obtain and store information stored in the RFID tag 62 attached to, or to be attached to food stored in the refrigerator, and display to the user, and storage means 74 for storing frames (user interface, and the like) to be displayed for food managing service formed controllable by the microcomputer 72 and food managing information.

Of course, the food managing refrigerator may further include a main microcomputer (not shown) for controlling operation of the freezing and refrigerating, with a communication line connected between the main microcomputer and the microcomputer 72 for making data communication. Or, the food managing refrigerator may control operation of the freezing and refrigerating by using the microcomputer 72. The food managing refrigerator is also provided with power supply means (not shown) for supplying power to the elements.

In detail, in order to able to obtain storage information from the RFID tag 62 attached to food to be stored in the refrigerator or a storage container (not shown) thereof provided by the user from an outside of the refrigerator, the RFID reading means 64 includes frequency generating means, transmitting means, and receiving means. It is preferable that the RFID reading means 64 can obtain identification information of the RFID tag 62 together with the storage information, and has a performance enough to read the RFID tag 62 when the user puts the RFID tag 62 close to the RFID reading means 64 within a predetermined distance.

It is preferable that the RFID reading means 64 is mounted at a height of the freezing chamber door 54*a* to which the user can lift the RFID tag 62 with convenience for making the RFID tag 62 to be read by the RFID reading means 64 (for an example, in a range of a height of a breast).

Particularly, the RFID tag 64 includes a RFID integrated circuit in a separate container having storage information (for an example, 4 days, 6 days, 8 days, and so on), and identification information (information on identification of the RFID tag). The identification information is composed of a series of numerals, such as '1', '2', and so on for convenience of reading by the user. A storage time period is an effective time period which is a limit of time period of storage of the food in the refrigerator corresponding to an expiration date of the food written on the food to be stored actually, or a time period the user sets up, arbitrarily.

The RFID tag 62 will be discussed in more detail. As shown in FIG. 4, the RFID tag 62 includes an antenna 62*a* for receiving a radio frequency from the RFID reading means 64, and transmitting a radio frequency including storage information and/or identification information to the RFID reading means 64, a RFID integrated circuit 62*b* for transmitting a radio frequency having storage information and/or identification information stored therein by using an energy of a radio frequency upon reception of the radio frequency, and upper, and lower coating portions 62*c*, and 62*d* coated on the antenna 62*a*, and the RFID integrated circuit 62*b* for protection.

In a case the RFID tag is attached to a separate storage container, the lower coating portion 62*d*, being a face to be attached to an exterior of the storage container the food will be placed therein, has at least attachment means (for an example, adhesive, or the like) (not shown), additionally.

The RFID tag 62 also includes identification means for identification with naked eyes of the user. The identification means (not shown) may be, for an example, colors, or numerals (related to storage information) on the upper coating portion 62. The identification means identifies the RFID tag from other RFID tag with respect to the identification information stored in the RFID integrated circuit 62*b*. For an example, if the identification means is the colors, with red for two days of an effective time period of storage, blue for four days of the effective time period of storage, and yellow for six days of the effective time period of storage, the user can know the effective time period of storage by looking at the color. Moreover, by providing a data base to the storage means 68 of the food managing refrigerator for reading the identification means by using such identification information, the microcomputer 72 can display identification means on the LCD display 82 in correspondence to the identification information to the user.

Of course, the food managing service may be applied to one of which quality or taste is mostly dependent on a stored period, such as dairy product, or to storage food of user's selection.

Next, referring to FIGS. 2 and 3, the input means 66, means for receiving an order from the user (for an example, reading of the RFID tag, addition or erasure of the food managing information), composes of an appropriate number of buttons, or the like in relation to the frame displayed on the display means. However, because no names of the stored food are required to be inputted at all, as shown in FIG. 2, the number is limited to around 6.

Next, the date and time counting means 68, means for defining year, month, date, and time when the RFID reading means 62 obtains the storage information and/or the identification information, provides the microcomputer 72 with the year, month, date and time of reception of a request upon reception of the request from the microcomputer 72.

Next, the microcomputer 72 controls processes of the entire freezing/refrigerating, and, in addition to this, provides a food managing service described in detail as follows.

The microcomputer 72, includes at least one central processing unit CPU (not shown) and may or may not include the storage means 74. However, in order to describe data stored in the storage means 74 in more detail, the specification describes the microcomputer 72 and the storage means 74 as separate elements.

The microcomputer 72 checks the storage conditions of the storage portions 56 with reference to the sensors 70, and sets up the storage portion 56 with reference to the storage information in the RFID tag 62 at the time of setting up the storage portion 56 based on the check.

Even if food is stored in the storage portion 56 set up thus, the microcomputer 72 controls various elements of the refrigerator, such as the compressor, the damper 90, and the cold air circulating fan for maintaining the most suitable storage condition, to maintain better freshness, taste, nutrition, and so on, to maintain the most suitable storage condition in view of temperature, humidity, composition of gas, a light quantity, and so on.

Of course, though the compressor, the damper 90, the cold air circulating fan can be controlled by the microcomputer 72, they may be controlled by the main microcomputer.

The microcomputer 72 is designed to manage the food according to the food managing information received from the RFID reading means 64, the input means 66, and the date and time counting means 68, and display the food managing information, and storage states of various kinds of food, and warning notices of remained effective number of days of storages of the various kinds of food.

Lastly, the storage means 74 stores at least frames to be displayed on the LCD 82 for the user to provide the food managing service the food managing refrigerator provides to the user, and the food managing information formed by the microcomputer 72. The frames are interface frames for easy use of the food managing information by the user. The food managing information includes at least the storage information of the RFID tag 62 attached to the stored food and/or the storage container thereof, and, in addition to this, the identification information, the storage starting date and time, or a number of stored days, and so on. The number of stored days is a number of days the RFID tag 62 is stored together with the food stored, actually.

Referring to FIGS. 2 and 3, the display means 80 includes an LCD (Liquid Crystal Display) 82 for displaying the frames (user interfaces) from the controller, the storage information, and the food managing information, and a light emitting diode (LED) 84 for indicating the storage portion 56 set up by the controller, and is controlled by the microcomputer 72.

In detail, the LCD 82 is mounted on the front of the refrigerating chamber door 54*a* at a height similar to the RFID reading means 64, and at a position similar to the input means 66, taking convenience of the user into account.

The LCD 82 may be designed to display insides of the freezing chamber and the refrigerating chamber as well as a position of the storage portion 56 separately at the time of setting up the storage portion 56.

Next, the LEDs 84 are mounted in correspondence to respective storage portions 56, so that, if the storage portion 56 is set up, the LED 84 for the storage portion emits a light, for user's notice of the storage portion and storage of food therein. Moreover, the LEDs 84 may be dual LEDs respectively for displaying the storage states of the food stored in the storage portion 56 to the user with different colors.

For an example, though the dual LED emits green when the food is stored in the storage portion 56 in a most suitable storage condition, or the effective number of days of storage of the food is remained more than the set up period, the dual LED emits red when the food fails to be stored in the storage portion 56 in the most suitable storage condition, or the effective number of days of storage of the food is remained less than the set up period.

The operation of the refrigerator for managing food by using RFID of the present invention will be described.

In order to formulate the food managing information, and manage the stored food, the microcomputer 72 displays the frames for the food managing service stored in the storage means 74 on the LCD 82. If the user selects the food managing service, the microcomputer 72 receives the order from the input means 66, and controls the RFID reading means 64 to obtain the storage information and/or the identification information from the RFID tag 62 attached to, or to be attached to the stored food and/or the storage container.

In this instance, if the user brings the RFID tag 62 attached to the stored food and/or the storage container within a predetermined distance from the RFID reading means 64, after the microcomputer 72 stores the storage information and/or the identification information obtained thus to the storage means 74 as the food managing information, the microcomputer 72 may store the same to the storage means 74 after the microcomputer 72 receives a user's order whether the storage information and/or the identification information read thus is stored or not.

At the same time with this, the microcomputer 72 requests the date and time counting means 68 for a time when the RFID reading means 64 obtains the storage information and/or the identification information, or when the storage means 74 stores the storage information and/or the identification information, and stores the time (i.e., a year, a month, a date and/or time) provided from the date and time counting means 68 to the storage means 74 as the food managing information together with the storage information and/or the identification information. Of course, the time provided thus is a storage starting date and time of the stored food of which effective number of days of storage varies with kinds of stored food and can be read from the RFID tag 62 for the stored food.

In the meantime, the microcomputer 72 receives and stores food storage information on the food intended to store from the RFID tag 62 of the food, obtains the most suitable storage conditions of the food with respect to humidity, a cold air flow rate, composition of air, vibration, and a light quantity from the most suitable storage information, compares the most suitable storage conditions to storage conditions of the storage portions 56 received from the sensors respectively, and designates the storage portion 56 as a result of the companson.

Then, the microcomputer 72 indicates the storage portion 56 by the LCD 82, or by the LED 84, or by opening the storage portion 56 by using the automatic opening/closing device, for the user to store the food in the storage portion 56. Then, the microcomputer 72 controls such that the storage portion 56 is maintained in the most suitable storage condition by controlling the compressor, the damper (not shown), the cold air circulating fan, and so on.

After obtaining the storage information and the food managing information of the food to be stored in the refrigerator through above process, the microcomputer 72 stores the information in the storage means 74 for future management. Thereafter, if the user intends to identify items (RFID tag) of the food stored in the food managing refrigerator presently, the microcomputer 72 reads the food managing information stored in the storage means 66, and displays the food managing information on the display means 25 if the user applies selection of a food identifying service to the input means 66.

In this instance, the microcomputer 72 reads the food managing information, obtains the present date and time (year, month, date and/or time) from the date and time counting means 68, calculates a stored number of days of the stored food, and displays on the LCD 82. The stored number of days is calculated by subtracting a storage starting date from the present date.

Moreover, for easy identification of the stored food by the user, the microcomputer 74 may display the food storage information in the order of the storage starting dates, or remained effective number of days of storage. Particularly, the microcomputer 74 may display the food storage information in the order of the storage starting dates if the stored food fails to contain the effective number of days of storage.

FIG. 5 illustrates one embodiment of the food managing information, wherefrom it can be known that the food managing information displayed on the LCD 82 includes storage time period information, identification information (or identification means) (may be omitted), storage starting date, and effective number of days of storage included in the storage information of the RFID tag 62 attached to the stored food. The warning message service of the stored food may be displayed, additionally. Moreover, as shown, in the case of food having the effective number of days of storage passed, the passed number of days may also be displayed as shown in cases of items '1' and '2'.

Moreover, the microcomputer 74 provides a noticing service on the remained effective number of days of storage of the stored food according to a user's selection or automatically by using the stored effective number of days of storage and the calculated number of stored days. The microcomputer 74 calculates the effective number of days of storage remained presently, and if the remained number of days is within a predetermined number of days storage, the microcomputer 74 provides the noticing service. The noticing service may be an warning message (display with character, or icon) on the LCD 82, or a various colors of light from the LED 84, or warning with a speaker (not shown) (sound, and so on).

For an example, if the remained effective number of days of storage is 3 days, the microcomputer 74 may start display of the warning message. Moreover, the warning message displayed thus may be varied with the remained number of days of storage, for attracting the user's attention. The warning message is stored in the storage means 74. Moreover, the microcomputer 74 may also display the warning message on the food having the effective number of days of storage passed on the LCD 82 or the LED 84.

Thus, the user is provided with service on the stored food by means of the RFID tag 62 attached to the food stored in the food managing refrigerator or the storage container thereof. It is required to erase the information on the stored food from the food managing information in a case the user releases the storage, and uses the stored food.

Accordingly, the microcomputer 72 displays the food managing information on food in storage presently on the LCD 82, receives food to be erased according to user's selection from the input means 66, and erases information on the food (such as the storage time period information, the identification information, the starting date of storage, a stored number of days, selection of the warning message service, and so on) from the storage means 74.

Moreover, the microcomputer 72 reads the information (the storage time period information, and/or the identification information) of the RFID tag 62 attached to the food of which storage is to be released by the user by means of the RFID reading means 64, and enables the user to input the storage release order through the input means 66. Upon reception of the storage release order, the microcomputer 72 may erase the food managing information including the information in the RFID tag 62.

Of course, after the erasure, the microcomputer 30 displays the food managing information on the RFID tags 62 attached to the food stored presently on the LCD 82.

The most suitable conditions of storage of various kinds of food, such as processed food, dairy products, vegetables, fruits, and grains, can be stored in the storage means 74 in forms of tables as shown in tables 1 and 2.

TABLE 1

| vegetables | Temp. | Gas emission | Light Q'ty | Others |
|---|---|---|---|---|
| Spinach, celery, onion | 0-5° C. | — | — | — |
| Tomato, cucumber, pimiento | 0-5° C. | — | — | No cooling |
| Potato | 21° C. | $O_2$ at 0-5° C. | Shield | — |
| Cabbage | 0° C. | — | — | 6 months storage |
| Broccoli | 0° C. | — | — | — |

TABLE 2

| Fruits | Temp. ° C. | humidity | Gas emission | Others |
|---|---|---|---|---|
| Banana | 17-21 | 85-95% | — | — |
| Lemon | 11-13 | 90-95% | — | — |
| Green tomato | 18-22 | — | — | Full maturity delay, store at 13-16° C. |
| Red tomato | 13-18 | — | — | Full maturity delay, store at a room temperature |
| Water melon | 13-21 | 85-95% | — | Sensitive to ethylene |
| Orange | 4-7 | 90-95% | ethylene | — |

TABLE 2-continued

| Fruits | Temp. ° C. | humidity | Gas emission | Others |
|---|---|---|---|---|
| Apple | 0-2 | 90-95% | ethylene | Store certain species at 2-4° C. |
| Grape | 0-2 | 90-95% | ethylene | — |
| Strawberry | 0-2 | 90-95% | ethylene | — |

Figure 6:
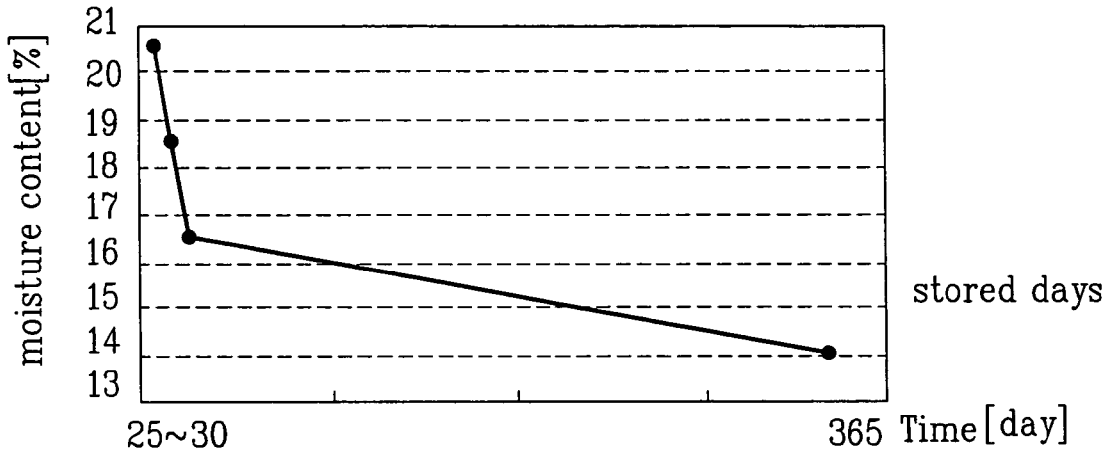
FIGS. 6 and 7 each illustrates a graph showing an optimum storage condition of grain applied to the present invention.
Figure 7:
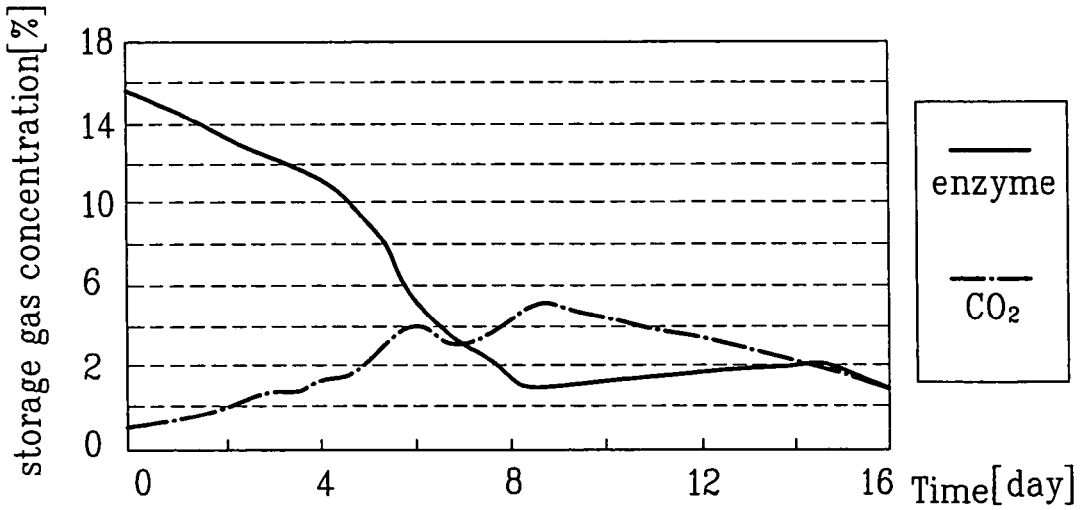

Referring to FIG. 6, grain can be stored in the best condition at a moisture content of below 15%, and can be stored for a long time period since no noxious insects can breed, and, referring to FIG. 7, the grain can be stored for a longer time period if storage air contains 3-5% $CO_2$. Besides, since fungi can propagates at a storage humidity of over 70%, the storage humidity is the most suitable at 50-70%, with a storage temperature of 10° C.

The refrigerator for managing food by using RFID of the present invention has been described in detail, taking a two door type refrigerator having a freezing chamber and a refrigerating chamber provided at opposite sides of the refrigerator as an example, with reference to the embodiment and attached drawings. However, it will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As has been described, since the refrigerator for managing food by using RFID obtains the most suitable storage condition from the storage information and the food managing information for the storage information on the RFID tag, enables to place the food at the storage portion in the refrigerator meeting the most suitable storage condition, and manages the food according to the storage information automatically, the refrigerator for managing food by using RFID of the present invention permits convenient management of the stored food at the most suitable space, and moreover, since the refrigerator for managing food by using RFID manages the storage portion to meet the most suitable storage condition by checking a temperature, humidity, storage gas composition, and a light quantity of the storage portion, the refrigerator for managing food by using RFID permits to enhance freshness, taste, and nutrition of the food.

What is claimed is:

1. A refrigerator for managing food by using Radio Frequency Identification (RFID) comprising:

a plurality of storage portions divided in the refrigerator for storing food;

an RFID tag being attached to food or a storage container containing food and having storage information of food stored in the storage portions;

a controller for identifying the RFID tag and reading the storage information from the RFID tag, the controller storing food managing information based on the read storage information, and the controller setting up the storage portion that maintains a storage condition based on the read storage information; and display means for a user to notice the storage information and food managing information based on the storage information, and the set up storage portion.

2. The refrigerator as claimed in claim 1, further comprising sensors for measuring storage conditions of the storage portions.

3. The refrigerator as claimed in claim 1, wherein the storage portions include movable shelves such that a position at a time of placing of the food in the storage of the food is different than a stored position of the food after placing of the food.

4. A refrigerator for managing food by using Radio Frequency Identification (RFID) comprising:

a plurality of storage portions divided in the refrigerator for storing food;

sensors on the storage portions for measuring storage conditions of the storage portions, respectively;

a plurality of RFID tags being attached to food or a storage container containing food and each having storage information of each kind of food to be stored in the storage portions;

a controller for identifying the RFID tag and reading the storage information from the RFID tags, the controller storing food managing information based on the read storage information, and the controller setting up the storage portion that maintains a storage condition suitable to the storage information read from the RFID tag from the storage conditions of the storage portions measured by the sensors; and display means for a user to notice the storage information and the food managing information based on the storage information from the controller, and the set up storage portion, wherein the display means includes a light emitting member mounted in correspondence to the storage portions respectively and the light emitting member being connected to the controller for indicating the storage portion with a light emitted based on the controller.

5. The refrigerator as claimed in claim 4, wherein the storage portions include movable shelves for moving in front/rear directions or up/down directions, respectively.

6. The refrigerator as claimed in claim 5, wherein at least one of the movable shelves is arranged at a particular position through which the food can be introduced to the refrigerator, and once the storage portion is set up, the at least one movable shelf moves to a position of the storage portion.

7. The refrigerator as claimed in claim 4, wherein the storage conditions include temperatures, humidity, cold air circulating rates, composition of air, vibration, and light quantities of respective storage portions.

8. The refrigerator as claimed in claim 4, wherein the controller controls such that, once the storage condition is set up, the storage portion maintains a storage condition suitable to the storage information.

9. The refrigerator as claimed in claim 8, wherein the controller includes:

a damper mounted on at least one cold air supply hole in one side of the storage portion so as to open/close the air supply hole for introduction of cold air passed around an evaporator of a refrigerating cycle mounted on an inside wall of the refrigerator into the refrigerator, and a microcomputer for controlling opening/closing of the damper so that the storage portion maintains a storage condition suitable to the storage information.

10. The refrigerator as claimed in claim 4, wherein the display means includes a liquid crystal display on a refrigerator door mounted on the refrigerator so as to be opened/closed, and the display means being connected to the controller.

11. The refrigerator as claimed in claim 10, wherein the light emitting member comprises light emitting diodes.

12. The refrigerator as claimed in claim 11, wherein the light emitting diode is a dual light emitting diode having at least two colors for turning on/off or for displaying various colors according to storage states of the food stored in the storage portions.

13. The refrigerator as claimed in claim 11, wherein the display means further includes automatic open/close devices mounted in correspondence to the storage portions so as to be opened/closed respectively and the automatic open/close devices being connected to the controller for opening/closing in response to a signal from the controller to indicate the storage portion.

* * * * *